US005148922A

United States Patent [19]

Marriott

[11] Patent Number: 5,148,922

[45] Date of Patent: Sep. 22, 1992

[54] GRAVITY PARTICLE SEPARATOR

[76] Inventor: Paul A. Marriott, Mullion Cottage, Bar Road, Helford Passage, Nr. Falmouth, Cornwall TR11 5LE, United Kingdom

[21] Appl. No.: 582,932

[22] PCT Filed: Apr. 25, 1989

[86] PCT No.: PCT/GB89/00439

§ 371 Date: Oct. 11, 1990

§ 102(e) Date: Oct. 11, 1990

[87] PCT Pub. No.: WO89/10197

PCT Pub. Date: Nov. 2, 1989

[30] Foreign Application Priority Data

Apr. 26, 1988 [GB] United Kingdom ..... 8809834

[51] Int. Cl.[5] ..... B03B 5/04; B03B 13/00

[52] U.S. Cl. ..... 209/489; 209/491; 209/503; 209/437

[58] Field of Search ..... 209/489, 491, 496, 500, 209/503, 504, 508, 437, 443, 557, 552, 435, 441, 576, 577, 592

[56] References Cited

U.S. PATENT DOCUMENTS

| | | | |
|---|---|---|---|
| 3,241,674 | 3/1966 | Weber | 209/504 |
| 4,078,996 | 3/1978 | Cohen-Alloro et al. | 209/504 X |
| 4,251,358 | 2/1981 | Mozley | 209/437 |
| 4,521,302 | 6/1985 | Stone | 209/508 X |
| 4,795,552 | 1/1989 | Yun et al. | 209/319 |
| 5,024,334 | 6/1991 | Hisra et al. | 209/489 X |
| 5,028,317 | 7/1991 | Lyman | 209/489 X |

FOREIGN PATENT DOCUMENTS

| | | | |
|---|---|---|---|
| 2603093 | 8/1977 | Fed. Rep. of Germany . | |
| 474356 | 6/1975 | U.S.S.R. | 209/489 |
| 780880 | 11/1980 | U.S.S.R. | 209/491 |
| 1479105 | 5/1989 | U.S.S.R. | 209/489 |
| 1576469 | 10/1980 | United Kingdom . | |
| 2150048 | 6/1985 | United Kingdom . | |

*Primary Examiner*—Donald T. Hajec
*Attorney, Agent, or Firm*—Larson and Taylor

[57] ABSTRACT

A gravity separator for the separation of heavier particles from lighter waste material comprises a stack of decks (4) mounted for resonant oscillatory motion within a supporting frame (1). A motor (9) oscillates the decks at their resonant frequency while a distribution system (6) supplies a feed in the form of a slurry to the surface of the decks. As shaking continues, the heavier particles within the slurry are gradually separated from the lighter particles. Optimal separation is provided by a control system which, if necessary, automatically changes the amplitude of oscillation and/or the timing of the stages as separation proceeds, for example in response to outputs of detectors which measure the frequency of oscillation and the power being consumed.

20 Claims, 6 Drawing Sheets 52
51
50
49
48
34
45
2
29
17
6
1
8
15
4
9
13
11
27
26
61
55
54
59
60
56
57
58
SLAVE ELECTRONICS
62
65
69
66
47
64
63
V.D.U.
MONITOR ELECTRONICS
MASTER & CONTROL ELECTRONICS
MONITOR CONTROL
GROUP CONTROL
TO & FROM ALL SEPARATORS

GRAVITY PARTICLE SEPARATOR

FIELD OF THE INVENTION

The present invention relates to a separator for the separation of heavier particles (usually metallic ore) from lighter waste material, or alternatively for the separation of larger particles from smaller ones. It relates for instance to a so-called "gravity" system of separation, in which the separation is accomplished by applying a slurry on to a sloping surface, and shaking the surface, thereby causing the heavier or larger particles (which tend to sink faster than the lighter or smaller waste particles) to be preferentially retained upon the surface, while the lighter particles flow off to waste. The invention is particularly effective (when compared with the prior art) in the separation of small particles.

BACKGROUND OF THE INVENTION

The general idea of separating particles using a vibrating inclined surface to which a slurry is applied is already known, for example from NRDC's British Patent Specification 1576469. This shows that it is known to suspend from a framework an assembly of vertically-spaced inclined decks to the upper edges of which a feed of the slurry is supplied while the decks are vibrated. A subsequent water wash removes separated ore particles which have collected on the decks.

This patent is merely exemplary of a number of known separators known as "gravity" separators. The common feature of all of these is a vibrating surface or deck. Some devices have provision for a continuous flow of material to be treated, while others operate on a series of cycles. It is particularly (though not exclusively) to devices of the latter class to which the present invention relates.

The standard nomenclature for this type of device is as follows. The separation surface is called a deck; in practice several such decks are often used at once, one above the other. The slurry of material fed to the deck for separation is called the feed. The heavy particle material to be collected as the finished product is called the concentrate; the actual proportion of heavy particles within this concentrate may vary considerably: when the device shown in GB1576469 is used to separate tin particles, the feed might typically consist of 1% tin, whereas the tin content of the concentrate from the device of the present invention might typically be 25% tin. The material collected for reprocessing and/or recirculation is called the middlings. The waste material, containing a low proportion of heavy particles is called the tailings.

Details of the cycling type of separator will now be described. A single cycle of such a separator consists of a feed stage, a wash stage, a middlings flush stage and a concentrate flush stage. A single cycle takes, for example, typically 8 minutes.

During the feed stage which takes approximately 4 minutes, the feed material is fed across the full width of the upper end of the sloping shaken deck so that it flows slowly down over the surface forming a layer of perhaps 2 mm to 5 mm deep. Much of the lighter waste material flows off the lower end of the deck during this period, but perhaps half still remains mixed with the heavier particles.

At the end of the 4 minute period, the feed is turned off and the washing commences. During this stage, wash water is fed from the upper end of the deck, which continues to be shaken. The washing action tends to assist in the separation process of the material on the deck; as the washing continues, the surface at the upper end of the deck largely clears of all the waste material, and leaves behind only the heavy concentrate. This clearance of most of the material continues slowly and progressively down the length of the deck. Thus, as one looks at the deck during the washing process, one can see that waste material is being cleared from the deck starting at its upper end with the edge of the cleared section being distinctly visible as a relatively broad band of change from lesser to greater density which moves slowly down the deck.

It will be appreciated that the upper end of the deck tends to collect little material, but including a relatively high proportion of denser particles. The amount and composition of the material changes progressively down the deck to greater quantities but of lesser concentration of denser particles. The washing stage is stopped after approximately 3 ½ minutes, after which time it found in practice that the concentrate (that is that portion of the material on the deck which has a sufficiently high concentration of heavy particles) is located in the upper three-quarters of the deck, while the middlings (that is material that is worth recycling) occupies the lower quarter.

During the next stage, the middlings flush stage, the material from the lower quarter of the deck is flushed off the surface with jets of water and is collected for reprocessing or recirculation This typically takes only about 5 to 10 seconds.

Finally, comes the concentrate flushing stage. During this stage, water jets are used to flush the concentrate off the remaining three-quarters of the surface into a collection trough. This takes typically 10 to 15 seconds.

It is important to realise that any separation plant needs to process material continuously, so separators of this kind must be arranged to work in pairs, or paired groups, so that there is no interruption in the flow of feed to a group of separators. Thus, the final three stages, namely the wash stage, the middlings flush stage and the concentrate flush stage must take no longer than 4 minutes, so that the separator is again ready to accept feed material for the next 4 minute period. In this way, one of the separators of the pair can be in the feed stage, while the other carries out the wash, middlings flush and concentrate flush stages.

One of the main disadvantages of the prior art is the very large number of manual adjustments that have hitherto been required Before setting up the apparatus for use the operator may typically have to adjust the tilt of the deck, the speed of oscillation, the stroke amplitude, the feed time and the wash time. The optimum values of these variables will depend upon, amongst other things, the relative densities of the heavier particles and the waste, the particle size distribution in the feed, the flow rate of the feed, and the density of the feed.

Traditionally, the required adjustments have been carried out by skilled personnel who relied merely upon trial and error, and upon experience. It has been clear for many years, however, that the required adjustments were so many, and the opportunities for comparative testing so infrequent, that even skilled personnel found it extremely difficult to obtain optimal or nearly optimal operating conditions, even where the feed rate was constant. In practice, the feed rate to such a separator oft en varies substantially with time, as may the particle distribution density within the feed, and even the particle composition within the feed. Under such circumstances, it has hitherto been difficult to obtain and impossible to maintain optimal operating conditions.

Traditionally, one or more operators in charge of a group or different groupings of parallel (but not necessarily similarly adjusted) machines have assessed how the machines were operating by visual inspection. Constant variations in the quantity and consistency of feed necessitate frequent inspection and adjustment of individual machines if the best performance is to be achieved. This is a function that is often difficult to maintain in practice particularly in the case of separators of the kind where effecting visual inspections is only possible for a short period within the total cycle time.

Finally, known separators have tended to be large and heavy machines, which are difficult and costly to maintain. Running costs have been high, since powerful motors have been required to drive the heavy separating surfaces.

In an entirely different field, difficulties have been experienced in achieving a uniform slurry flow rate across the entire width of the deck. This tends to result in the separation proceeding more rapidly in some places than in others, so making it more difficult to find a single horizontal cut-off line, above which the material on the deck will be collected as concentrate, and below which it will be recycled as middlings.

SUMMARY OF THE INVENTION

It is an object of the present invention at least to alleviate some of the problems of the prior art.

Another object of the invention is to obtain higher recovery rates, particularly for small particles, than has previously been possible.

Another object is to provide a separator of an improved design that requires lower power consumption, and that is simpler, lighter and cheaper to manufacture and to maintain.

Another object is to provide a separator which can more easily be run at optimal or near optimal conditions, even when the feeding conditions vary. A related object is to provide a machine that is easier to set up, and which can be run at high efficiency even by relatively unskilled personnel.

Another object is to provide a means whereby a group of separators may be centrally controlled by a single operator, and/or maintained at high efficiency.

A final object is to provide an improved flow distribution over the width of a deck.

According to the present invention there is provided apparatus for the separation of particles, the apparatus including a surface mounted for resonant oscillatory motion, characterised in that the apparatus comprises actuation means arranged to maintain the oscillation of the surface at substantially its resonant frequency, detection means arranged to detect a parameter of the separation operation and to produce an output signal representative thereof, and control means responsive to the said output signal and arranged to control operation of the separator as separation proceeds, the detection means including means to detect the said resonant oscillation frequency.

The deck is desirably mounted so that opposed springs provide the restoring force. The springs may be attached between a static supporting frame and the vibrating deck Alternatively, if the apparatus includes a plurality of vertically stacked decks, the springs may be attached between the static support frame and a vibrating frame carrying the decks.

The detection means may include a detector to detect the instantaneous position of the oscillating surface, and resonant oscillation may be maintained by providing cyclic thrusts on the vibrating deck, for example by means of various types of electric motor which may constitute the actuation means. The pulses of current to the electric motor may be controlled by the signal from the detector to the actuation means as to their timing, pulse length and amplitude, to maintain the required resonant oscillation. The detector means may be a displacement transducer coupled between the supporting frame and the vibrating deck.

The apparatus includes at least one detector arranged automatically to measure the resonant oscillation frequency, and control means arranged to control the operation in dependence upon the output of the detector. Such measurement may be provided in the form of an alternating electrical signal which may be derived from the aforementioned displacement transducer coupled between the supporting frame and the vibrating deck.

Another measurement that can be made in accordance with the invention is of the amplitude of oscillation of a separation deck.

Another detector may be of the optical or ultra-sonic type and may for example be arranged to give some indication of the state of the material on the deck. This could be done by measuring the reflectivity, at a particular point, to an infrared beam or to ultra-sound.

Such an optical or ultra-sonic detector may alternatively be arranged to move automatically to follow the progress of material down the deck during the washing process; a position transducer comprising another part of this detector arrangement may provide a signal representative of the position of the detector along the deck and thereby the progress of the washing stage.

Another parameter that can be measured during operation is the amount of power that is required to sustain a particular amplitude of oscillation Such a measurement may be achieved in various ways, for example by measuring the electrical power which is consumed in providing the thrusts. Conveniently, where the thrusts are provided by an electric motor of the kind in which the armature is energised by pulses of direct current, the power being supplied can be determined from the length of the pulses.

A combination of the measurements of the power being consumed and the frequency of oscillation has been found to be of particular usefulness in providing automatic control.

Another parameter that can be measured during the operation is the total weight and possibly the distribution of weight of the oscillating surface, that is, the suspended vibrating deck or deck assembly. If the deck is suspended from a number of wires from a framework, one or more of the wires may include a strain gauge arranged to give an electrical output dependent upon the weight carried by that wire. The same principle can be applied to gravity separators or conveyors where screens or meshes are used for size separation and where information from the moving screens is used to control the amplitude of oscillation according to the load. The present invention is intended to encompass such devices.

The primary parameter that is controlled in dependence upon the output of the detector or detectors is the amplitude of oscillation of the deck. If the apparatus is of the type requiring separate stages for feeding, washing, middlings flushing and tailings flushing, then automatic control of the length of each of these periods may be provided, depending on the output of one or more of the detection means.

In addition, automatic control could be provided for many parameters which are currently either fixed or manually adjustable. Examples include the tilt of the deck, the rate of feed of the slurry, the rate of feed of the washing water, and so on.

The apparatus includes control means responsive to the output signal of the detection means and arranged to control the actuation means whereby oscillation of the deck is maintained at substantially its resonant frequency. Operation of the apparatus may be controlled by adjusting the timing and power of pulses applied to the surface by the actuation means.

Desirably, the amplitude is maintained within certain limits of a predetermined relationship to the frequency of vibration. The amplitude control may be achieved by automatically controlling the force and/or the duration of the thrusts.

Manual control means may be provided for changing the said predetermined relationship Typically, these means may comprise means for introducing a multiplicative factor into the relationship.

Tests have established that, for a particular type of deck surface and a particular slurry of particles to be separated, most efficient separation can be achieved if the amplitude of vibration is inversely related to the square of the frequency of vibration. The constant of proportionality may change according to the particular feed, and may also be arranged to change during the separating operation.

Over-ride means may be provided whereby, if a detector ascertains that a given parameter is outside a predetermined range, at a particular point of the cycle, the said predetermined relationship can be over-ridden. This may conveniently be achieved by automatic adjustment of the multiplicative factor.

The present applicant, after undertaking thousands of tests, aimed at determining the relationship between the efficiency of a gravity separator and the values of its various adjustable parameters, has surprisingly found that manual adjustment by an operator is not required on many of these. The gravity separator may have a number of parameters which are either fixed (e.g. preset by the manufacturer) or which are automatically adjustable, with no manual operator adjustment being provided. These parameters may include for example the following: the tilt angle of .the deck, the rate of flow of the feed, the .rate of flow of the wash water, the time period for the feed stage, the time period for the washing phase, the time period for the middlings flushing stage, the time period for the tailings flushing stage, and the power input for oscillating the deck. By manual operator adjustment is meant an adjustment that might reasonably be carried out by a skilled operator of the separator, on site; and by no adjustment being provided is meant that no adjustment is provided which would have any substantial effect upon the performance of the separator.

In one convenient arrangement, manual adjustments are reduced to one simple control, the setting of which depends upon the material to be separated. This single control may act to vary the multiplication factor mentioned above.

Accordingly, apart from the single control, the separator may require no manual adjustment whatsoever (other than initial levelling) prior to use by the operator.

In certain circumstances (e.g. to enable the separator to cope with a very different feed material), there may be provision for mechanical adjustments to be made by the manufacturer or by a skilled person. For lesser but still substantial variation in feed material, modification to the operation of the separator could be. accomplished by substitution of a plug in memory programme circuit to the electronics that would provide greater changes to parameters than those automatically adjusted within any one programme.

An additional advantage of eliminating mechanical adjustments is that all the separators in a group will operate in an exactly similar manner.

Where, as will often be the case, there are two or more separators acting simultaneously as a group (whether physically adjacent or not) the cost of providing automatic detectors can be reduced by providing some of the instruments for one separator only, and ensuring that all separators operate under the same conditions of feed flow, so that measurements from one separator can be used to control the operation of all the separators of the group.

A set of apparatus for the separation of particles may comprise a master separation apparatus as hereinbefore defined and at least one other separation apparatus, the control means of the master separation apparatus being arranged to control the said at least one other separation apparatus.

Information transfer means may be provided for transferring information on the operation of each separator to a centralised control means, where, for example, the various parameters of the operation can if necessary be displayed. Desirably, there may be means for monitoring operation of the set by automatically comparing parameters of the various separators and automatically producing a warning at the central point if any parameter is abnormal.

Such centralising of information can also be used to indicate changes to the input conditions, namely the type of feed material, its rate of flow, or other factors which may be outside the remit of the automatic control of the separators, and providing warnings if necessary.

Thus, a group of separators can easily be set up with only a single manual adjustment, and monitored centrally by an unskilled person.

The gravity separator may include a separation deck, and flushing means, for providing flushing liquid onto the deck, the flushing means being movable over the surface of the deck. Such an arrangement is simpler and cheaper than the usual process of tilting the whole assembly in order to remove the material which has collected on the deck.

A movable gantry may be provided to which the flushing means are secured, and which may also carry an optical detector, and a transducer arranged to provide a signal in dependence upon the position of the gantry.

The gravity separator may include divider means arranged to ensure substantially even distribution of feed flow over the total width of the deck. Desirably, the divider means may also be used for providing an even distribution of washing water or other liquid.

Such means could comprise a number of splitter boxes, each of which divides the incoming liquid into two equal outputs. A combination of such splitter boxes can divide up the feed as finely as is desired.

The invention may be carried into practice in a number of ways, and one specific embodiment will now be described by way of example, with reference to the accompanying drawings in which:

DETAILED DESCRIPTION OF THE PREFERRED EMBODIMENT

Figure 1:
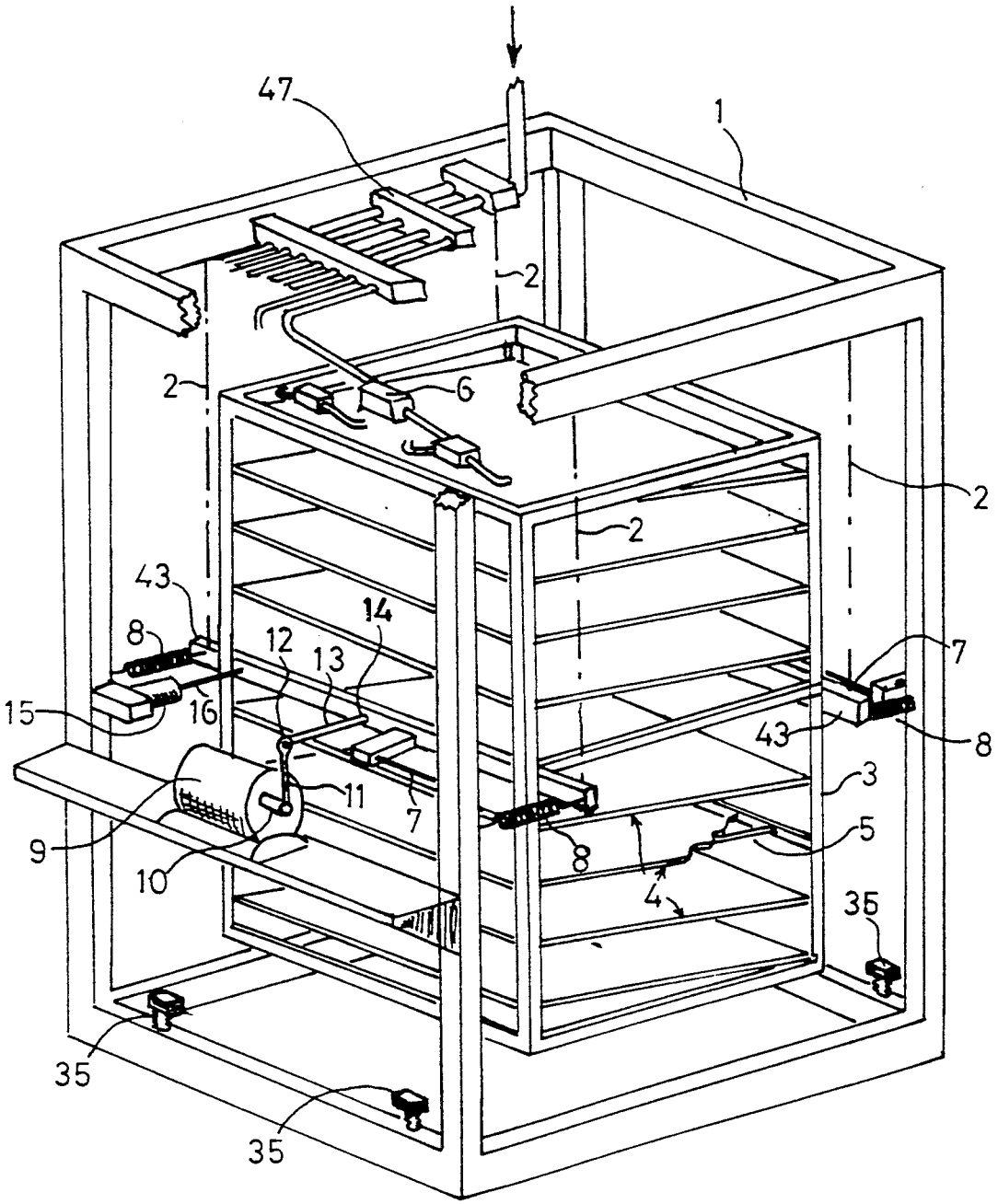
FIG. 1 is a sketch showing the general arrangement of a particle separator.

The separator of FIG. 1 comprises a rectangular supporting frame (1) for floor mounting and provided with levelling screws (35). A deck assembly (3) is suspended from two opposite horizontal arms of the frame by vertically depending wires (2), each connected at its lower end to one of the outer ends of a pair of horizontal stretcher arms (43), one on each of, and forming an integral part of, the deck assembly (3). The deck assembly (3) comprises a rectangular framework supporting a number of vertically-spaced, parallel decks (4), which are inclined downwardly from one edge at an angle of perhaps 1.5° to the horizontal. The surfaces of the decks are desirably flat and are of a nature chosen to suit the particular feed to be processed. If appropriate, the deck could be provided with riffels or undulations to assist in collecting the concentrate.

There is a distribution system (6) (of the type that will be described later with reference to FIG. 6.), associated with each deck for supplying the feed and the wash water. Only one of these is shown in FIG. 1 in the interests of clarity. The distribution system (6) may be mounted to the frame (1) or to the deck assembly (3). However, the deck assembly (3) is arranged to be vibrated horizontally in a direction perpendicular to the length of the stretcher arms (43) by means of an electric motor (9) mounted on the frame (1) and having, on its shaft (10), a crank (11) coupled to the centre of one of the stretcher arms (43) through a connecting rod (13) and swivel joints (12, 14) at each end. In other arrangements (not shown) the deck assembly could be arranged for vibration in a direction parallel to, rather than perpendicular to, its slope. It would also be possible (although this is not shown) to arrange for a greater lateral vibration of the lower edge of the deck than of the upper edge of the deck for example by means of two motors, one driving near the top end and one near the bottom end at the side. Alternatively, an orbital motion could be provided by means of two motors (not shown) operating at right angles to one another, together with two transducers and two pairs of opposing springs, one at right-angles to the other. Likewise, the motion could be non-sinusoidal, if desired, by the use of opposing springs of differing force-characteristics.

The vibratory motion is constrained to be in the direction defined by means of a pair of rods (7), each pivotally secured at one end to the frame (1) and at the other end to a point on one of the two stretcher arms (43). The rods extend horizontally, one on each side of the deck assembly, and effectively prevent vibration in the direction of the stretcher arms (43). The weight of the deck assembly (3) in conjunction with the support wires (2) effectively prevents vibration vertically so that the vibration is restricted to being in the preferred direction - horizontally perpendicular to the lengths of the stretcher arms. Typically, the entire assembly will swing over a small arc of perhaps 1 cm to 2 cm.

The deck assembly (3) is made as light as possible consistent with maintaining the flatness of the decks when they are loaded with feed.

Four springs (8) are provided at the sides of the assembly (3), each extending horizontally between a point on the frame (1) and a horizontally-spaced point at one end of the stretcher arms (43), to provide a restraining action to movement of the assembly. Of course, only two opposing springs might be appropriate in some cases Since two of the springs pull the assembly in one direction, and two in the other, the assembly will naturally take up a mean position with the spring forces being equalised. Thus, the hanging assembly (3) together with the springs (8) can undergo resonant oscillation in a horizontal direction.

The springs (8) are tension springs, but they could equally well be compression springs.

Means are provided for maintaining the oscillation of the assembly (3) at substantially the resonant frequency. In the present embodiment, these means comprise the motor (9), although a number of other well-known expedients could be used to provide the thrusts necessary to keep the deck assembly vibrating. Other possibilities include hydraulic or pneumatic actuating means or a linear motor. An electromechanical transducer could be used which could be, for example, a moving coil type transducer; however it is more convenient for cost reasons to use a modified form of DC electric motor This modified motor might be shunt wound or permanent magnet field direct current electric motor, having no commutator.

The field coils of the motor are fed continuously with a suitable DC current, but the armature is fed from a suitable electronic circuit (which will be referred to again later with reference to FIG. 7) arranged so that current may be passed through it in either direction. Current pulses are passed to the armature at the right moment and in the direction, so as to provide the necessary push and pull on the deck assembly to maintain the resonant oscillation.

The actual oscillatory stroke of the assembly (3) is monitored by means of a displacement transducer (15), the output of which is used to control the motor (9), so as to give a desired stroke length. This will be described in more detail later with reference to FIG. 7. The displacement transducer (15) has its body connected to the frame (1) and its sensitive element (16) connected to one of the stretcher arms (43), so providing an output signal representative of the instantaneous displacement of the vibrating deck assembly.

Figure 5:
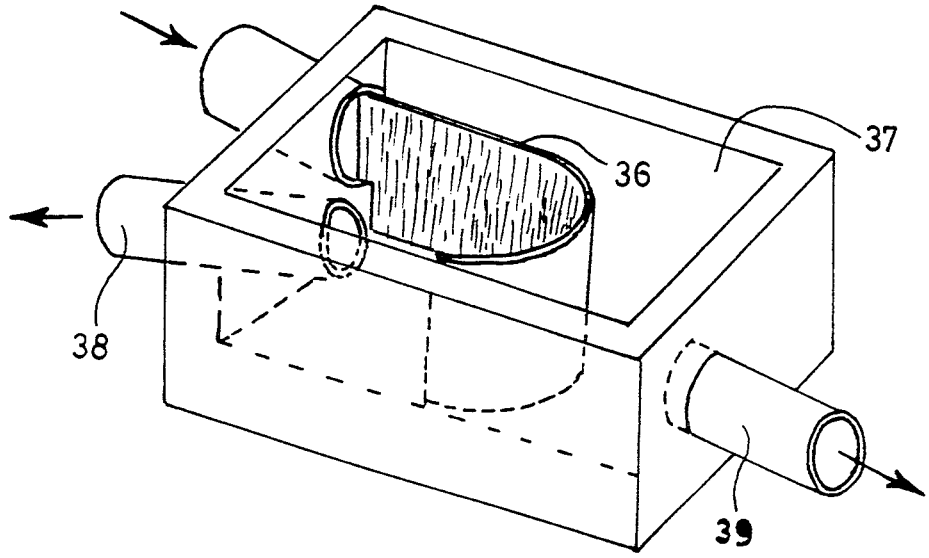
FIG. 5 is a sketch of a splitter box for providing the feed to the separator of FIG. 1.
Figure 6:
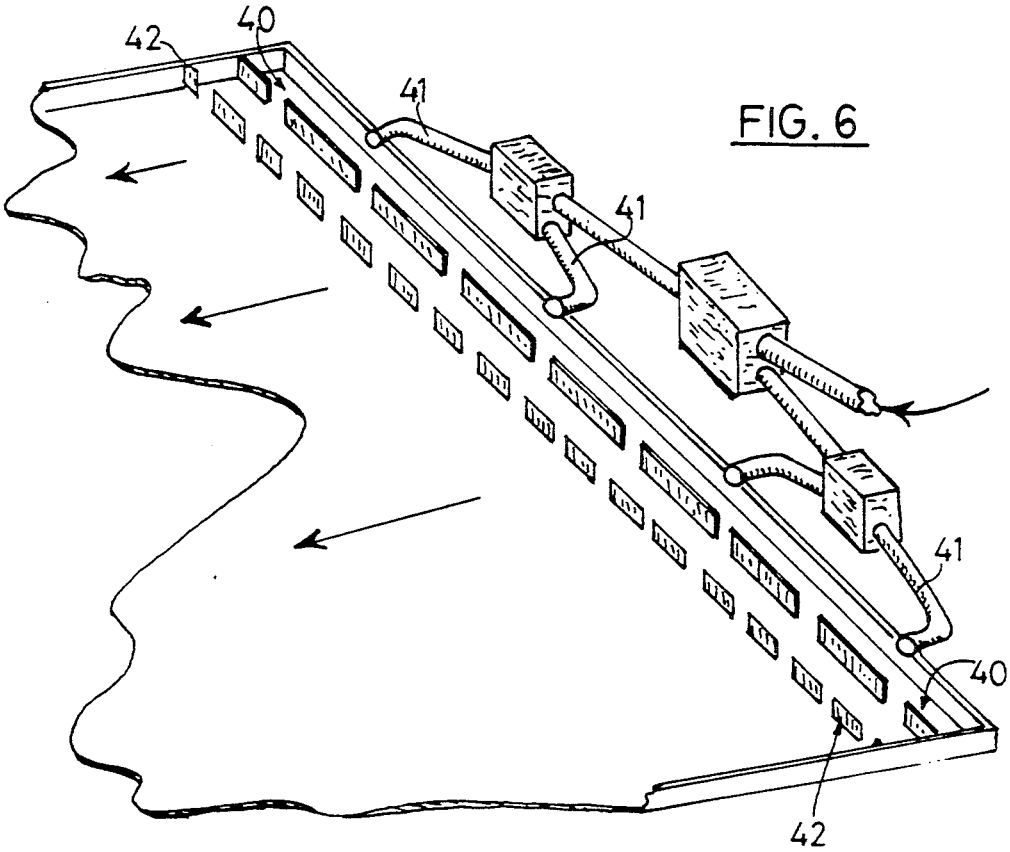
FIG. 6 is a diagram showing how, by using the splitter boxes of FIG. 5, the feed can be distributed over the width of a deck.

In operation, a feed consisting of heavy particles (perhaps of a metal to be recovered and lighter sand to be rejected) suspended in a liquid of a slurry is supplied to the upper edge of each of the decks (4) by the distribution system (6) of FIG. 6. Incoming feed is fed to a splitter box (37) (FIG. 5) which includes a divider wall (36) separating the feed into two equal volumes, and delivering them respectively to outputs (38 and 39). As shown in FIG. 5, if the divider plate is curved through nearly 180° the two outlets can flow in opposite directions. Alternatively, they could flow out on the same side, or even underneath.

FIG. 6 shows how a combination of three such splitter boxes can be used to divide the feed into four laterally-spaced positions (41). If they are fed into a trough (40) along the upper edge of a deck, and that has a first downstream wall having eight equally spaced openings, and a second downstream wall (42) having sixteen equally spaced openings, a very uniform distribution of the fluid over the width of the deck can be achieved. The trough (40) and the walls (42) can, but need not, be fixed to the deck.

As the feed stage continues, with the slurry passing over the vibrating decks, material starts to collect on the deck, with the heavier particles preferentially being retained, and much of the lighter particles in suspension tending to flow off the lower edges of the decks for collection in a manner which will be described later with reference to FIG. 3.

After a certain time (typically 4 minutes) the feed stage is stopped, and the washing stage commences. The end of the feed stage can be either after a fixed period of time, or can be defined by the output of one or more of the detectors which will presently be described.

During the washing stage which typically lasts for 3 ½ minutes, wash water is provided via the distribution system (6), so as to flow over the surface of the decks. As this washing process continues, the surface of the upper end of the deck largely clears of all waste material, and leaves behind only the heavier particle concentrate. This clearance of most of the material continues slowly and progressively down the length of the deck. The washing stage is terminated after a desired period of time, which may either be fixed or determined according to the output of one or more of the detectors still to be described.

Next follows the first of two flushing stages (the middlings flushing stage) when material nearer to the lower edge of the decks that contains insufficient concentrate to be collected as a final product, but sufficient heavier particles to be worth reprocessing and/or recirculation is removed. To effect this removal flushing water is caused to flow over the decks from a source, shown in FIG. 4, consisting of a common vertical feed pipe (28) on a movable platform (30), having an individual horizontal branch pipe (29) for each of the decks. Each branch pipe (29) is positioned closely above its respective deck and is directed to provide flushing water from a row of jets spaced over the width of the deck and directed downwardly at an angle of perhaps 45° towards the lower edge. For the purpose of flushing the middlings from the lower edges of the deck, the pipes (29) (FIG. 4) are located at Position A. (FIG. 3). Typically, this stage takes only 5 to 10 seconds; it may be terminated either after a fixed time period has elapsed, or in dependence upon the output of one or more of the detectors to be described.

It would also be possible to have more than a single middlings collection stage. In such a case, the jets would be positioned initially fairly near the bottom edge of the deck so as to collect the middlings into a fourth collection trough (not shown). The jets would then be moved a little further up the deck, and actuated again to collect the rest of the middlings into the other middlings collection trough.

Finally, comes the concentrate flushing and collecting stage. As will be seen in FIG. 4, the assembly of flush water pipes (28, 29) is carried by a platform (30) which can be moved on rails (31) extending horizontally from the frame above the deck assembly so that the positions of all the pipes (29) can be moved from the Position A. (FIG. 3) to the Position B. This movement is achieved by operation of a pneumatic actuator (34) having a piston (33) and a mechanical linkage (32). The speed of movement is controlled by a flow valve in an airline to the actuator. During the concentrate flushing stage the water jets are actuated with the pipes (29) in the Position B, flushing the concentrate off the lower edge of the deck. Typically, this stage lasts approximately 10 to 15 seconds and may be terminated once again either after a fixed time has elapsed, or in response to an output of one of the detectors to be described.

To achieve effective flushing off of the concentrate, the platform moves slowly downwards over the deck from its initial Position B, the water jets flushing off the concentrate as they go.

Figure 3:
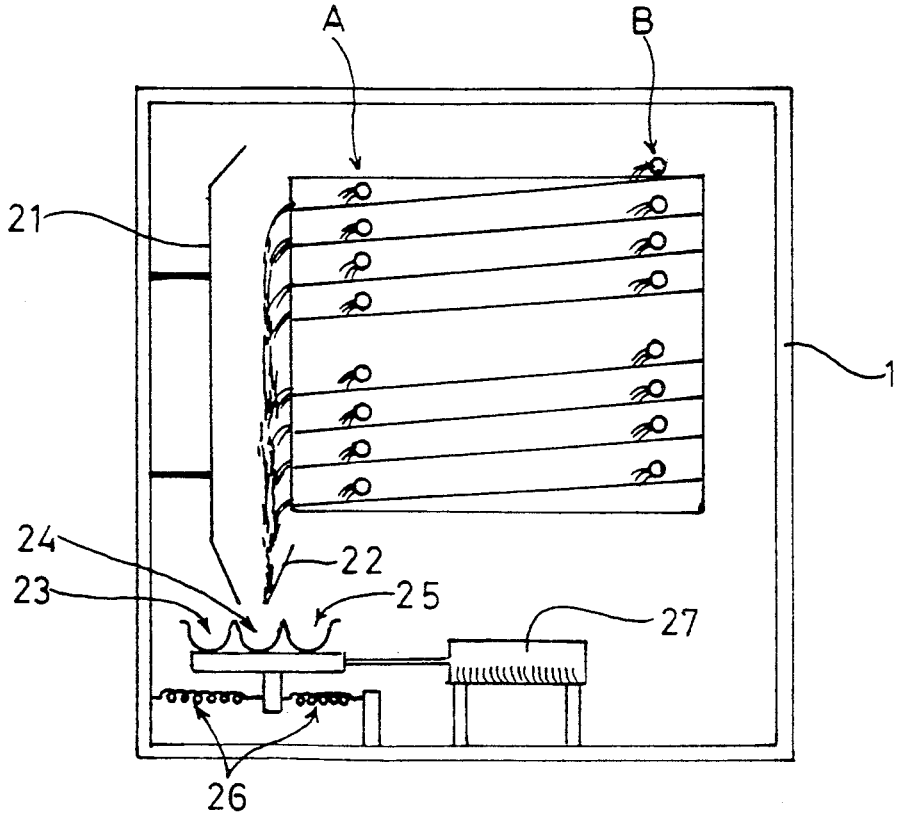
FIG. 3 is a diagrammatic side-view showing the arrangements for collecting material from the separator depicted in FIG. 1.

Turning now to FIG. 3, it will be seen how slurry flowing off the lower edges of the decks is collected between a guide plate (21) and a lower guide (22) and directed to one of three troughs or launders (23, 24 and 25) respectively for middlings, tailings and concentrate. The trough assembly is normally biased by a pair of springs (26) into a position in which the flow is directed to the tailings trough (24) but operation of an actuator (27) can cause either the middlings trough (23), or the concentrate trough (25), to be positioned to collect the flow. During the feeding and washing stages, the material running off the lower edges of the decks flows into the tailings trough (24) which flows to waste; during the middlings flushing stage the material flows into the middlings trough (23) for reprocessing and/or recirculation; and during the concentrate flushing stage, the material flows into the concentrate trough (25) for collection. Other arrangements, for example involving a single trough and valves that direct materials to the appropriate collection positions, are of course possible.

As with all devices of this general type, it will be appreciated that the separators will generally be used in pairs, to allow continuous flow of feed to the pair. Accordingly, the length of the feed stage should be equal to the combined lengths of the washing and flushing stages.

Figure 7:
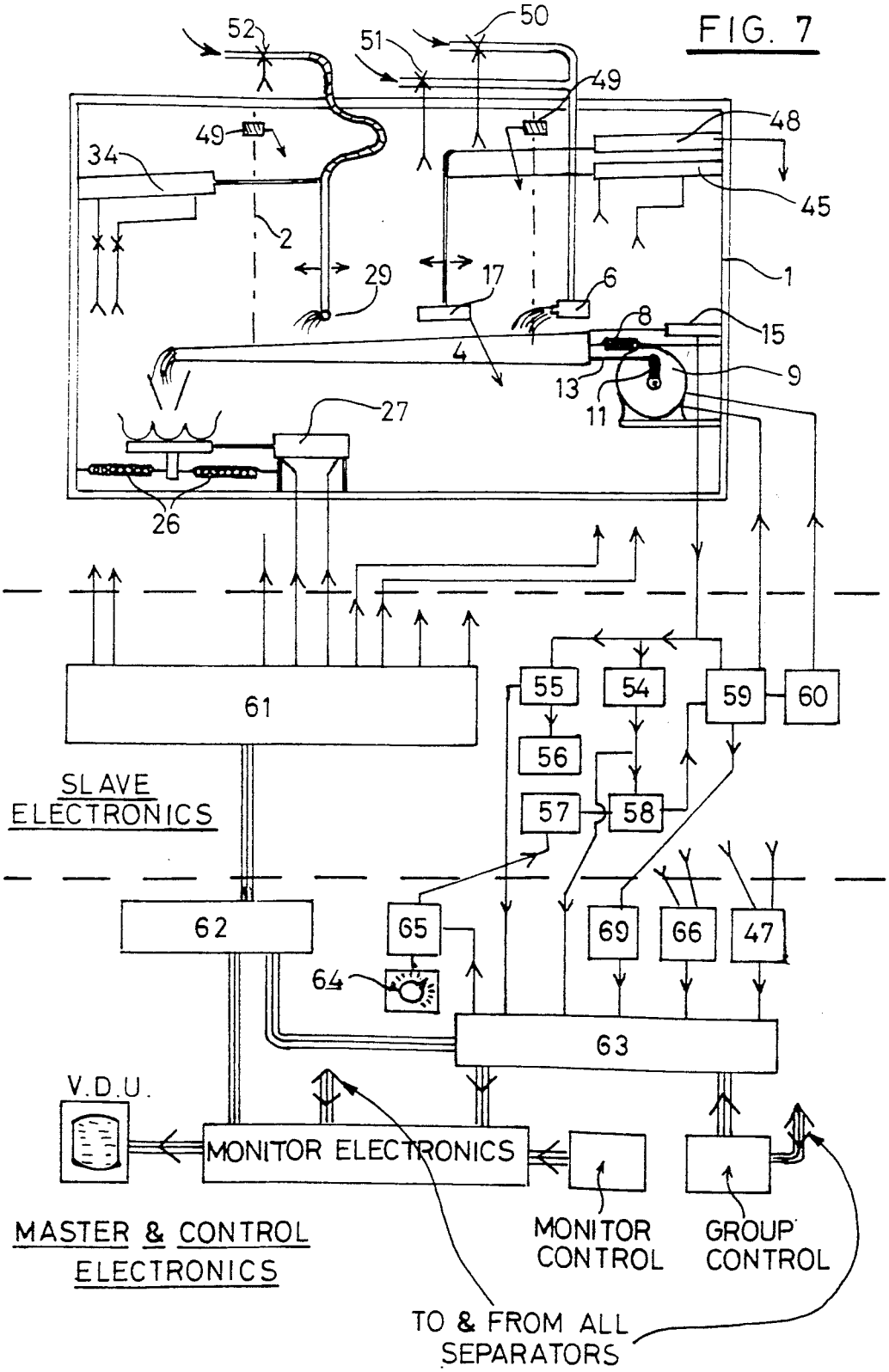
FIG. 7 is a schematic diagram showing the electronic control of the separator of FIG. 1.

The automatic control arrangements for the separator of FIG. 1 will now be described with reference to FIG. 7.

Typically, separators of the type shown in FIG. 1 will be operated in pairs so as to allow for a constant flow of feed to each pair. Several pairs may be operated together, as a group, with one separator of that group (the master separator) having certain additional timing and control circuitry which is used to effect the automatic adjustment of all the separators within the group.

In the description below, the separators other than the master separator will be designated "slave" separators.

All of the separators in the group, both master and slave, will include the electronics shown above the lower dotted line in FIG. 7. As has previously been mentioned, the oscillation stroke of each separator is controlled by monitoring the output of the displacement transducer (15). By experiment, an empirical formula has been found which provides for a given oscillation frequency, a suitable length of stroke. The formula is:

$$l=(60/f)^2F$$

where: l is the amplitude of vibration in centimeters, and that f is the frequency of vibration in cycles per minute, and that F is a factor which depends upon the material being processed. Typically, this factor lies within the range 12 to 22.

Although this formula appears to be only approximate, and is valid only over a limited range of frequencies, it has nevertheless been found that good results can be obtained even as the input conditions of the feed vary, if the stroke length is constrained according to this formula The factor F, being the only arbitrary constant in the formula has to be chosen by the operator prior to using the separator, for example by means of a manually-operable knob. Once this factor has been chosen (and since it depends largely upon the material which is to be processed it will be easy to provide a table which gives an appropriate starting value for each material), separation will continue at high efficiency and without need for further intervention by the operator, even as the feed conditions change.

It will be appreciated of course that even if the input conditions remain constant, the stroke length will vary throughout the cycle as the natural resonant frequency changes. The resonant frequency f of course depends upon both the total amount of material on the decks, and also upon the amount of shearing that is occurring within the slurry as the deck is oscillated. Thus, the resonant frequency will to some extent be dependent upon the extent to which the particles within the slurry are sticking to the deck, or on the other hand to the extent to which they are remaining in suspension.

Turning back now to FIG. 7, the electronics required to put into effect the above formula will be described. This electronics which is shown above the lower of the two dotted lines in that Figure, will be present in each of the separators of the group, both master and slaves.

The generally sinusoidal voltage signal from the displacement transducer (15) is fed to a peak to peak rectifier circuit (54) which provides an output voltage in dependence upon the amplitude of oscillation.

The output from the displacement transducer (15) is also fed to a circuit (55) which provides an output voltage proportional to the oscillation period. This output voltage is fed through a squaring circuit (56), and from there to a multiplying circuit (57). A second input voltage applied to the multiplying circuit comes from the master separator electronics and represents the factor F. This will be described later.

Thus, the output from the multiplier (57) represents the required stroke length 1. This is fed to a comparator (58) which compares that voltage with the voltage from the peak to peak rectifier circuit (54). Thus, the output of the comparator (58) is a signal representative of the error between the actual and the desired stroke lengths.

The error signal is fed to another circuit (59) which produces electrical pulses which are fed to the motor (9). The length of these pulses are caused to increase or decrease according to the signal from the comparator (58), so as correspondingly to increase or decrease the stroke length to its correct value. The timing of the pulses to maintain the resonant oscillation is derived from the signals received from the displacement transducer (15). A DC power supply (60) is provided which feeds continuous power to the field coils of the motor, and also to the pulse-producing circuit (59).

In an alternative arrangement (not shown) the amplitude of oscillation could be altered by varying the amount of current passed through the armature of the motor, keeping the lengths of each pulse constant.

Each separator of the group also includes an electronic switching circuit (61) which receives its instructions from the master separator electronics, to be described below, the purpose of which is to control the various mechanical functions (other than the motor) of the separator.

The electronics of the master separator shown below the lower dotted line of FIG. 7 will now be described. In practice, at least part of this electronics could be situated at the location of a combined central control/-monitor, to be described below.

The timing of all the changes from one stage to another, namely feed, wash, middlings flush and concentrate flush, is generated by a master timing circuit (62) which provides the signals which are fed to the control unit (61) of each separator. Thus, the master timing circuit, via the control unit, controls a feed valve (50), a wash water valve (51), a flush water valve (52), the launder position cylinder (27), and the flush water position cylinder (34). The master timing circuit (62) provides alternate signals to at least two batches of separators within a group, so as to allow for continuous feed.

The master timing circuit (62) may have one or several of its timing periods over-ridden by a master adjustment controller (63). The most likely of these would be that for controlling the washing time.

The master adjustment controller (63) receives signals from all the sensing devices fitted on the master separator, and provides output signals in dependence upon the signals received which are used to effect the various automatic adjustments required to achieve a high efficiency operation of all the separators. It receives signals from the circuit (55) (a voltage proportional to the oscillation period), and from a circuit (69) providing a voltage proportional to the power being taken to maintain the required amplitude of oscillation. This voltage is calculated using, as input, the pulse signals from the pulse-producing circuit (59).

The master separator (but not the slave separators) is fitted with one or more strain gauges (49) (FIG. 7) in the support wires 2 which carry the deck assembly (3), to give some indication of the static weight on the decks. The output of these gauges is fed to a circuit (66), which provides as output a voltage signal proportional to the weight of material on the deck surface of the master separator. This signal is then fed to the master controller, where it is used to assist in the determination of the amount of the material that is sticking to the deck. Using the measured frequency alone, the controller has insufficient information to determine the extent to which the natural resonant frequency has been altered by additional static material building up on the deck (that is material which is sticking to the deck), and changes due to shear forces within the slurry. Frequently, discrimination can be made on the basis of the power that is being taken to drive the deck at its resonant frequency; clearly, larger power is required if much of the material is remaining in suspension, and therefore subject to shearing losses. Sometimes, however, the oscillation frequency and the power being consumed may not be sufficient to determine the matter; in such a case discrimination can be improved by the additional information from the strain gauges.

It would also be possible, if separate strain gauges were to be provided at the two edges of the deck, to make some estimate of the way the material is spread out on the deck.

Further information from the master separator is available to the master controller (63) from a circuit (47). The input to this circuit is derived from a position transducer (48), which measures the position on a deck of the master separator of an optical sensor (17), which is arranged to move down the deck automatically to follow a position of constant light reflection or density of material on the surface.

Figure 2:
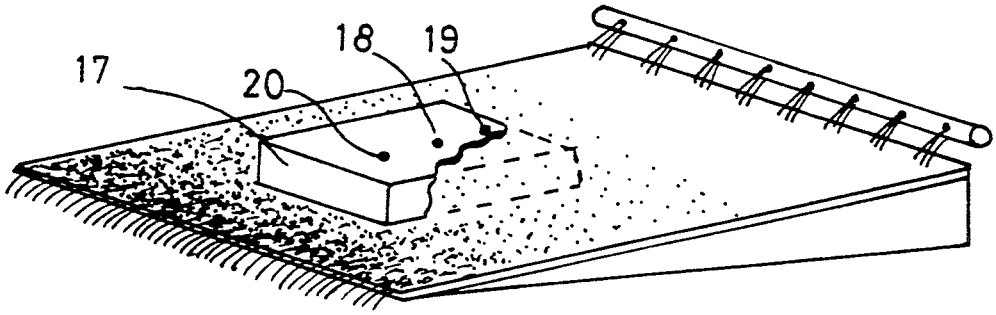
FIG. 2 is a sketch of an optical detector for use with one of the decks in the separator of FIG. 1.

The optical sensor (17) is shown in FIG. 2. It comprises a box, open at its lower surface and positioned over the deck surface so as partly to prevent ingress of ambient light. The surface enclosed is illuminated by an infrared, light-emitting diode (18). Two infrared, photodetecting diodes (19 and 20), respectively positioned towards the upper and lower edges of the deck will respond to infrared radiation reflected by the material on or from the surface of the deck. The amount of reflection will depend upon the density of material on the surface, so that a comparison of the output of the diodes (19 and 20) can give an indication of the falling-off in material quantity over that part of the deck. A pneumatic cylinder (45) (FIG. 7) is provided which moves the box slowly down the deck following the position of maximum density variation of material as the wash cycle proceeds. Thus, the signal from the position transducer (48) gives some indication of whether the wash cycle is proceeding at the expected rate.

Figure 4:
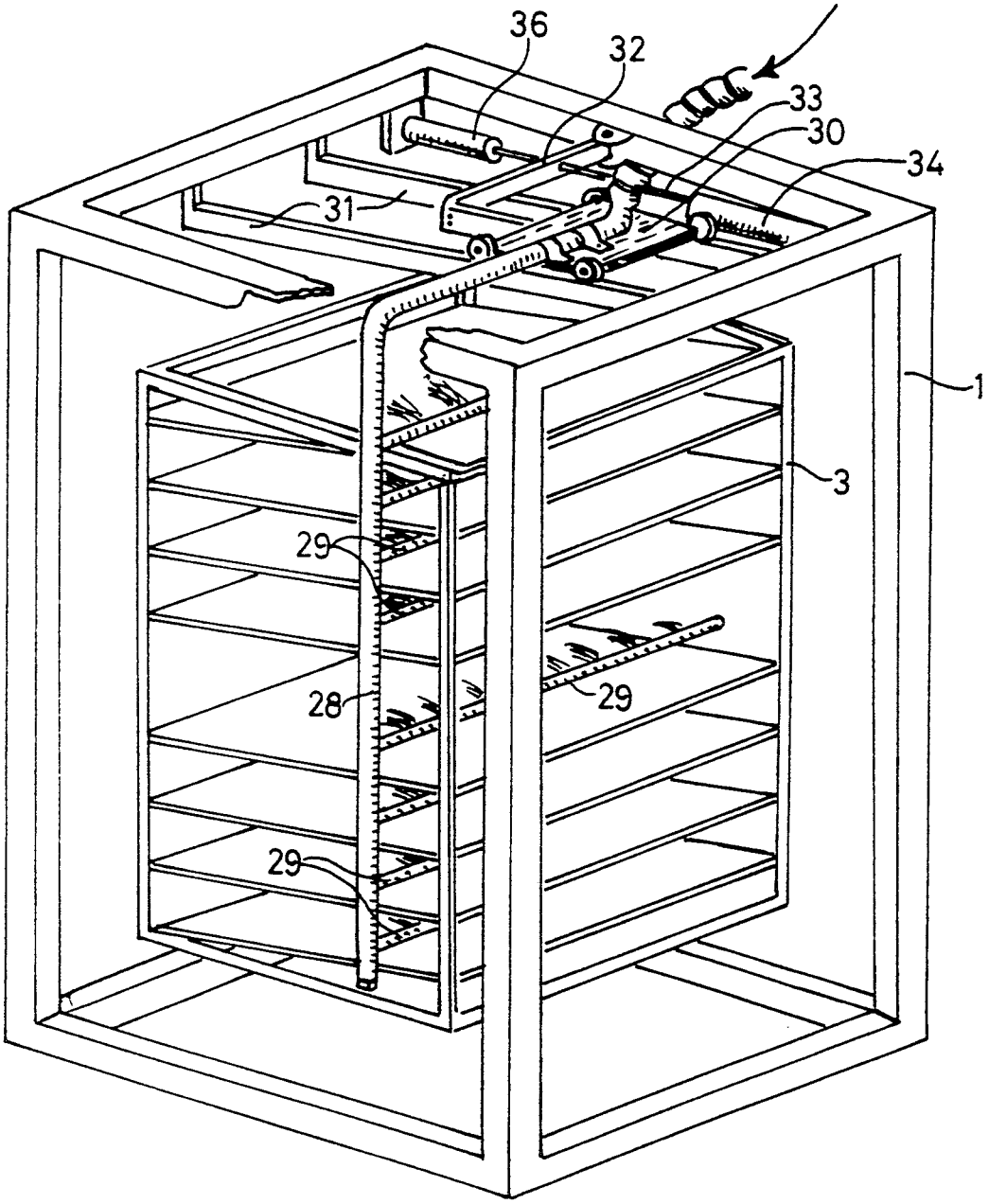
FIG. 4 is a view corresponding to FIG. 1 (but turned horizontally through 90°) showing the arrangements for providing flush water to the separator of FIG. 1.

It would be possible, if desired, to mount the optical sensor (17) on the movable platform (31) (FIG. 4). Alternatively, the optical sensor (17) could be fixed and could be arranged to produce a signal when the density of the material underneath it reaches a certain level Such a signal could be used to decide when the wash stage should be stopped.

Instead of infrared light, an ultra-sonic signal could be used, since such signals will be reflected by differing amounts by material of differing densities.

The master adjustment controller (63) includes memory devices programmed to provide an output representing the desired ideal variation of certain of the incoming sensor signals or combination of such signals throughout the entire time period of operation. The actual signals or combinations of signals from the sensors may be compared with those in memory so as to provide error signals which can be used to modify the operation of the slave separators.

For example, if the system determines that the washing stage is proceeding too slowly—so that it will not be completed in its allotted period; that is, the length of the feeding period less the lengths of the flushing periods—the controller could be arranged to increase the amplitude of oscillation 1. This could be done by overriding the voltage output from a manual control (64) which is the means whereby the operator initially sets the value of F for all separators. This over-riding is by means of a summing circuit (65) fed from the master controller (63) and the manual control (64). Thus it is the summer (65) which provides the input to the multiplying circuits (57) for all the separators.

Such a modification of the factor F effectively alters the stroke of each of the separators away from that given by the manual control (64). This would occur only if the system detects that too much or too little material is sticking to the deck, when the deck is operated using a stroke as defined by that formula.

Thus, the two major and most useful automated adjustments effected by the master controller are to the timing circuit that alters the wash time period and that of over-riding the manual setting from the controller (64) to alter the stroke length 1.

Figure 8:
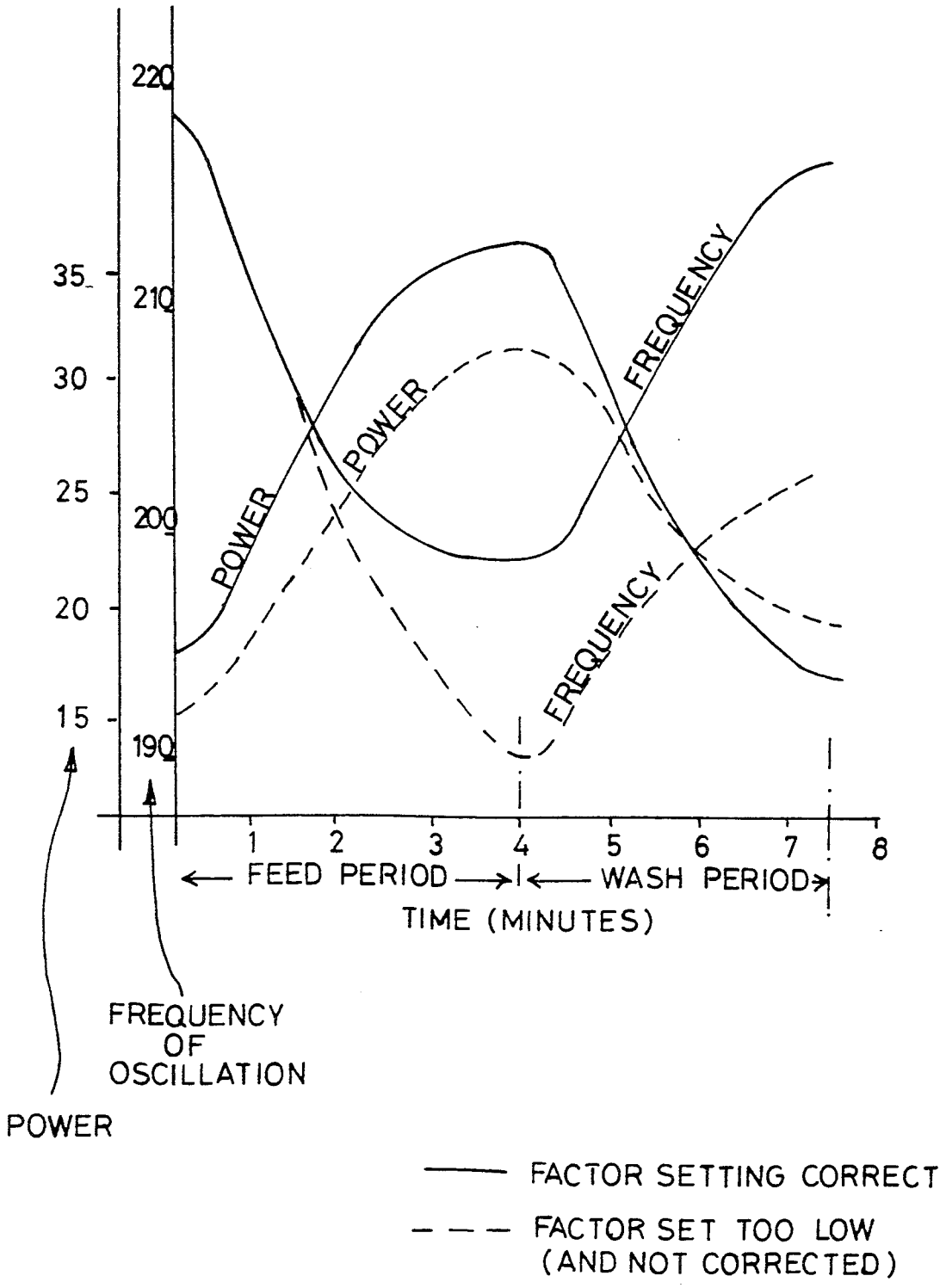
FIG. 8 is a graph showing how the power taken to oscillate the deck, and its frequency, varies during the cycle.

The operation of the automatic adjustments might perhaps be better understood by reference to the illustrative graphs of FIG. 8. These shown how the power taken to drive the oscillation, and the frequency of oscillation, vary during the 8 minute cycle. The solid line represents a factor F which has been correctly chosen according to the material that is to be processed, and the dotted line too low a value. It will be observed that the full frequency curve has returned almost to its original value by the end of the 3 ½ minute washing period, whereas the dotted frequency curve has not done so; instead, the wash has not been completed within the allocated 3 ½ minute period, and has overrun. Although it is not easy at the start of the feeding period to distinguish these two situations, by measuring the frequency alone, when one looks at the power taken one sees a clear distinction. Clearly, in the case of the dotted line, the controller (63) would have recognised that the power consumed was too low, when compared with a value stored in the memory, and have indicated the necessity to increase the stroke length.

It should be noted, however, that the curves of FIG. 8 are representative of a fixed feed rate. If the feed rate were to be increased, the curves would be different. In such a case, the in-coming signals from the various sensors would have to be adjusted in dependence upon the measured feed rate. It is here that the output of the strain gauges (49) could be used to assist in the calculation.

Various other signals might be generated by the master controller (63) to improve the efficiency of separation. For example, the signal from the master controller (63) to the summer (65), to alter the stroke length, may be different at different times of the cycle. For instance, in some cases a shorter stroke length during the early stages of the feed period provides improved separation.

Other inputs to the master controller (63) could also be envisaged, for example that of temperature. This might be required for example in near freezing conditions, where the rapidly changing viscosity of water is likely to need compensating for. Other automatic adjustments could be envisaged for example the angle of tilt of the decks. Clearly, any of the variables that have traditionally adjusted by hand could be automatically controlled.

Thus, the present invention provides the means for monitoring the vibration frequency of the bed during the slurry feeding and washing stages, and altering the shaking of the bed to maintain the resonant vibration frequency.

When a group or different groups of separators are in operation then all may be monitored and controlled from a central location.

For monitoring purposes every slave and master separator would be connected—probably by a multiplexing arrangement—to the central monitor which would be fed with signals of oscillation frequency, amplitude, and power (pulse length) from each separator and from the additional sensors on the master separator. One purpose of the monitor would be to act as a warning device to indicate malfunction on any of the individual separators. The warning could be of an audible and/or visual nature and the indication be by a video display unit screen upon which the number of the separator and nature of the fault would be displayed.

The information required to trigger such a warning would be readily available by employing averaging circuits for averaging the normally relatively small variations of frequency, amplitude and power of each of the separators in the group and by employing a comparator circuit able to assess when any signal from any separator departed too far from the average.

For instance if an excess of material were building up on a deck on one separator due to a partially blocked flushing water pipe, then the frequency of oscillation would be considerably reduced and would be detected Another warning of malfunction or of inefficient operation might for instance be that of supplying too much or too little feed to a group of separators or to individual separators within the group. Again such information would be readily available and would be produced by comparing the power taken by separators to upper and lower limits set at the monitor.

The second purpose of the monitor would be that of helping to assess the .efficiency of operation of the separators. Here further information might be fed to the monitor from instruments external to the system, such as feed flow rate in tonnage and in fluid flow. The combination of such data with that received from the separators might be combined for instance to indicate suggested alterations to feed inputs to groups of separators so as to achieve greater efficiency.

The description previously given indicated that a master separator was provided with additional sensors and with additional electronics that provided signals to the slave separators to modify or over-ride certain fixed settings. There could be considerable advantages particularly in large installations in locating the master controller (63) part of the electronics at the same location as the monitor. The factor setting (64) could be adjusted from that location and in the event of the operator wishing to make certain changes such as an alteration to the memory programme in use, it would be accomplished at that location. This might be required when some variation of feed material was occurring.

The location of a central control for a group of separators would offer many other advantages, for instance the control of start-up of separators.

This could be achieved by providing signals from the control location that started the sequence of the four stages of the separators so that all did not start at once and that phasing of groups was correctly achieved.

Another example is that of start-up after a period of power failures. This would normally leave separators with material upon the decks that required much washing and flushing before proper operation recommenced. This could be accomplished from the central location by controls that ensured and monitored sufficient washing and flushing to make sure that the separators were ready for re-introduction of feed. The flushing sequence could be automated to operate many times over to achieve this effect and the state of being ready to start on any machine could be detected for instance by the oscillation frequency which would indicate when material was no longer resting upon the surface. Other controls such as reduction of the number of separators being used in the group could also be controlled from the centralised location.

Circuitry for the wide range of monitor and special control activities is not specifically described as so many various functions might be arranged. In all the circuit descriptions above concerning the whole electronics it should be mentioned that one method only of achieving certain results has being given when many other methods could have been employed. In practice, many of those functions described could be accomplished within a single microprocessor component.

What is claimed is:

1. Apparatus for the separation of particles, the apparatus including a surface mounted for resonant oscillatory motion, characterised in that the apparatus comprises actuation means arranged to maintain the oscillation of the surface at substantially its resonant frequency, detection means arranged to detect a parameter of the separation operation and to produce an output signal representative thereof, and control means responsive to the said output signal and arranged to control operation of the separator as separation proceeds, the detection means including means to detect the said resonant oscillation frequency.

2. Apparatus according to claim 1, in which the detection means includes a detector to detect the instantaneous position of the oscillating surface, and said control means is governed by the signal from that detection to provide pulses of current at the correct timing, pulse length and amplitude, to the actuation means so as to maintain the required resonant oscillation.

3. Apparatus according to claim 1, in which the detection means includes a detector of the resonant oscillatory amplitude.

4. Apparatus according to claim 1, in which the detection means includes means for determining the amount of power being consumed by the actuation means.

5. Apparatus according to claim 1, in which the detection means includes means to detect the weight of the oscillating surface.

6. Apparatus according to claim 5, in which the oscillating surface comprises a deck suspended from wires and the detection means comprises one or more strain gauges each associated with a suspension wire.

7. Apparatus according to claim 1, in which the detection means includes an optical detector.

8. Apparatus according to claim 1, in which the control means are arranged to control the actuation means to maintain the amplitude of vibration at a predetermined relationship to the resonant frequency of vibration.

9. Apparatus according to claim 8, in which the control means are arranged to control the actuation means to maintain the amplitude of vibration at a value which is substantially inversely proportional to the square of the resonant frequency of vibration.

10. Apparatus according to claim 8, including override means arranged automatically to override the predetermined relationship if a detector determines that a given parameter is outside a predetermined range.

11. Apparatus according to claim 1, of the type having separate feeding washing and flushing stages and in which the control means are arranged to provide automatic control of the timing of the respective stages.

12. Apparatus according to claim 11, in which the timing of one or more of the respective stages is altered in dependence on the output of said detection means.

13. Apparatus according to claim 1, including means to measure the frequency of oscillation of the surface, a displacement transducer to monitor the oscillation stroke of the surface, the control means further including means to produce signals in dependence on the frequency and the amplitude of oscillation; means to produce a signal proportional to the oscillation period; means to produce a signal representing a factor which relates the amplitude to the frequency and for indicating the required stroke; means for comparing the actual amplitude with the required stroke; and means for producing electrical pulses of varying length or current to increase or decrease the actual stroke to its required value.

14. Apparatus according to claim 13, in which the factor is automatically varied in response to detected changes in frequency or other detected parameters.

15. Apparatus according to claim 1, in which a master controller is arranged to receive signals from said detection means and to provide output signals in dependence thereon to effect automatic adjustments to control the separation operation.

16. Apparatus according to claim 1, in which the apparatus comprises a gravity separator.

17. A set of apparatus for the separation of particles, the set comprising a master separation apparatus as claimed in claim 1, and at least one other separation apparatus, the control means of the master separation apparatus being arranged to control the said at least one other separation apparatus.

18. A set of apparatus for the separation of particles, each as claimed in claim 1, including centralised control means arranged to receive signals from each apparatus in the set and to control each said apparatus.

19. A set of apparatus according to claim 18, which the centralised control means includes means for monitoring operation of the said set and for warning of the occurrence of certain events connected with the said operation.

20. A method for the separation of particles, the method including the steps of passing a slurry of the particles to be separated over a sloping surface and oscillating the said surface, characterised by maintaining the oscillation substantially at the resonant frequency of oscillation, detecting said resonant frequency as a parameter of the separation operation and producing an output signal representative thereof, and applying said output signal to control means to control the separation operation as separation proceeds.

* * * * *